US006828496B2

(12) United States Patent
Paiste

(10) Patent No.: US 6,828,496 B2
(45) Date of Patent: Dec. 7, 2004

(54) CYMBAL

(75) Inventor: Robert Paiste, Nottwil (CH)

(73) Assignee: Paiste AG, Nottwil (CH)

( * ) Notice: Subject to any disclaimer, the term of this patent is extended or adjusted under 35 U.S.C. 154(b) by 0 days.

(21) Appl. No.: 10/362,918

(22) PCT Filed: Aug. 21, 2001

(86) PCT No.: PCT/CH01/00512

§ 371 (c)(1),
(2), (4) Date: May 9, 2003

(87) PCT Pub. No.: WO02/19314

PCT Pub. Date: Mar. 7, 2002

(65) Prior Publication Data

US 2003/0167900 A1 Sep. 11, 2003

(30) Foreign Application Priority Data

Aug. 28, 2000 (EP) ..... 00118607

(51) Int. Cl.[7] ..... G10D 13/02
(52) U.S. Cl. ..... 84/422.3; 84/422.2; 84/402
(58) Field of Search ..... 84/422.3, 422.2, 84/402

(56) References Cited

U.S. PATENT DOCUMENTS 3,640,029 A * 2/1972 Zildjian ..... 451/53
4,462,296 A * 7/1984 Heiskell ..... 84/422.4
6,034,313 A 3/2000 Shelley

OTHER PUBLICATIONS

"1998 Newsbeat Catalogue", SABIAN, New Brunswick, Canada No. XP002159166, p. 8.
PCT/IPEA/416 and 409's (in German and with English translations) conducted in International Application No. PCT/CH01/00512.

* cited by examiner

*Primary Examiner*—Shih-Yung Hsieh
(74) *Attorney, Agent, or Firm*—Greenblum & Bernstein, P.L.C.

(57) ABSTRACT

Cymbals for percussion instruments generally comprise an umbrella-like annular area (3), which is at least approximately circular, and comprise a central convex dome (5). According to the invention, at least portions of the cymbal surface have non-contiguous and/or irregular structural elements (9), which extend, for example, in a circumferential direction. The structural elements are preferably little notches that are produced by means of a rotating milling tool.

21 Claims, 2 Drawing Sheets

CYMBAL

CROSS-REFERENCE TO RELATED APPLICATIONS

The present application is a National Stage Application of International Application No. PCT/CH01/00512, filed Aug. 21, 2001. Further, the present application claims priority under 35 U.S.C. §119 of European Patent Application No. 0011867,1 filed on Aug. 28, 2000.

BACKGROUND OF THE INVENTION

1. Field of the Invention

The present invention relates to a cymbal which is primarily used as a percussion instrument or in combination with percussion instruments such as in particular drums and the like.

2. Discussion of Background Information

Cymbals, which are chiefly made either of bronze, i.e. a copper/tin alloy, or other copper alloys or optionally another suitable metal or a metal alloy, are, as a rule, provided on their surface with one or more grooves produced by machining. These grooves extend largely concentrically on the cymbal surface, running from outside to inside. A specific sound is made by these grooves produced by machining.

In U.S. Pat. No. 6,034,313 a cymbal is proposed that features on its surface a plurality of linear, tonal nicks. These run as a rule radially, linearly from the center of the cymbal surface towards the outer edge.

Due to the continual new trends in musical styles and in particular the use of percussion and rhythm instruments in a great variety of musical fields, there is a permanent desire to develop ever new sound characteristics, i.a. also for cymbals.

SUMMARY OF THE INVENTION

It is therefore an object of the present invention to create a cymbal with a new sound characteristic.

Instead of using a machining tool such as, for example, a cutting tool to produce a largely continuous groove on the cymbal surface, it is proposed according to the invention to use, for example, a milling tool, by way of which a non-continuous or irregularly continuous structure is formed that runs in the circumferential direction of the cymbal surface. The resulting structural element can be ultra-small nicks that as disconnected grooves extend, for example, from outside to inside on the outer or upper surface respectively, or inner or lower surface respectively, of the cymbal. These irregular and/or disconnected structural elements can be arranged over the entire upper or lower surface of the cymbal, or else over part of the surface, for example as ring-like segments that extend concentrically on the surface of the cymbal.

The irregular and/or disconnected structures proposed according to the invention are preferably produced by way a rotating tool such as for example by way of a rotating milling tool or milling head.

The invention also provides for a percussion instrument that comprises a cymbal that includes an umbrella-like ring area and a central domed cupola. The umbrella-like ring area is at least almost round and comprises a surface. Features are arranged on the surface in a circumferential direction. The features are at least one of non-continuous and irregular nicks formed by a milling tool.

The features may be ultra-small nicks. The features can be arranged as ring segments. The features can be arranged on only part of the surface. A density of the features can vary from the cupola to an outer periphery of the cymbal. A density of the features can be different in different circumferential areas of the cymbals.

The surface may comprises an upper surface. The percussion instrument mat further comprise a lower surface that includes the features. The surface may comprise a lower surface. The percussion instrument may further comprise at least one of at least one continuous groove, at least one hammered area, and at least one worked surface area arranged on the surface.

The surface may comprise an upper surface. The percussion instrument may further comprise a lower surface that includes the features.

The invention also provides for a method of making the percussion instrument described above, wherein the method comprises subjecting the surface to the milling tool while the milling tool rotates.

The subjecting may comprise subjecting at least part of the surface to the milling tool while the milling tool moves inwardly towards the cupola. The subjecting may comprise subjecting at least almost an entire part of the surface to the milling tool while the milling tool moves outwardly away from the cupola. The subjecting may comprise subjecting at least almost an entire part of the surface to the milling tool while the milling tool moves outwardly away from the cupola. The subjecting may comprise subjecting at least almost an entire part of the surface to the milling tool while the milling tool moves outwardly away from the cupola.

The method may further comprise guiding the milling tool to vary a depth of penetration of the features. The method may further comprise forming some of the features with a depth of penetration and forming other features with a different depth of penetration.

The invention also provides for a cymbal that includes a central opening, a lower surface and an upper surface. Features are arranged concentrically on at least one of the lower surface and the upper surface. The features comprise at least one of non-continuous nicks and irregular nicks that are formed by milling.

The invention further provides for a method of making the cymbal described above, wherein the method comprises subjecting the surface to the milling using a milling tool to form the features.

The invention is now explained in more detail below by way of example and with reference to the attached Figures.

BRIEF DESCRIPTION OF THE DRAWINGS

The Figures show:

FIGS. 3*a*, 3*b* and 3*c* show different surface features or structures wherein:

FIG. 3*a* shows conventionally known grooves;

FIGS. 3*b* and 3*c* shows disconnected structures according to the invention and;

DETAILED DESCRIPTION OF THE INVENTION

Figure 1:
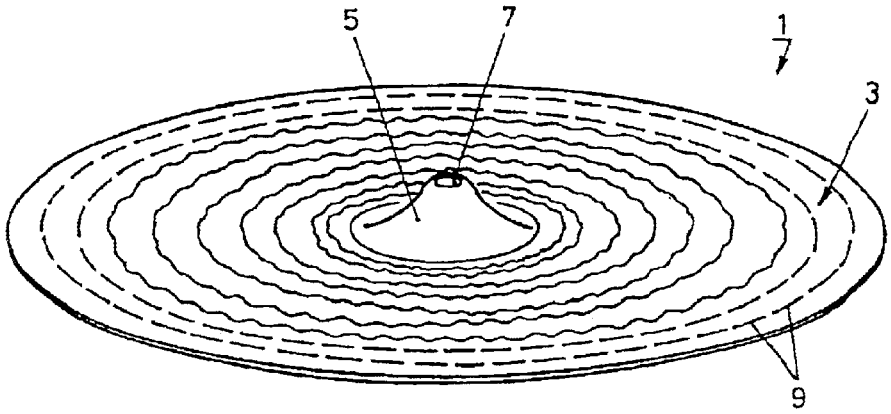
FIG. 1 shows perspective and in plan view, a cymbal embodied according to the invention.

FIG. 1 shows a cymbal 1 that features a ring area 3 domed in an umbrella-like manner as well as a central cupola 5 featuring a central hole 7, for example for arranging the cymbal hanging on a stand. The disconnected structures 9 are now shown schematically in particular on the umbrella-like ring area 3, which structures extend largely over the entire surface on this ring area in the circumferential direction.

Figure 2:
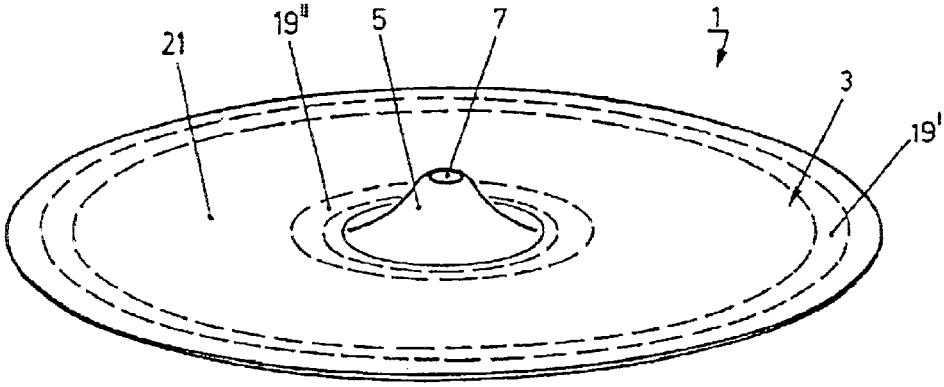
FIG. 2 shows a further embodiment variant of a cymbal according to the invention.

FIG. 2 shows a further embodiment variant whereby a disconnected structure 19' according to the invention is arranged at the outer edge of the umbrella-like ring area 3 as well as centrally in the area of the transition to the central cupola 5. Between the two ring-segment-like areas 19' and 19" provided with the structure according to the invention, there extends a ring-like area 21 that either can be completely flat, or can feature a hammered structure, or else a groove-like structure as known for conventional cymbals. Of course, the representation according to FIG. 2 is merely by way of example, and it is absolutely possible to arrange several ring-segment-like areas embodied according to the invention, or else the ring-segment-like areas at places other than those shown in FIG. 2.

Figure 3A:
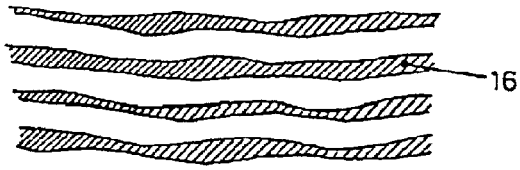
FIG.3a PRIOR ART

In FIG. 3*a* a conventional groove structure is shown schematically, as is well known from the prior art.

Figure 3B:
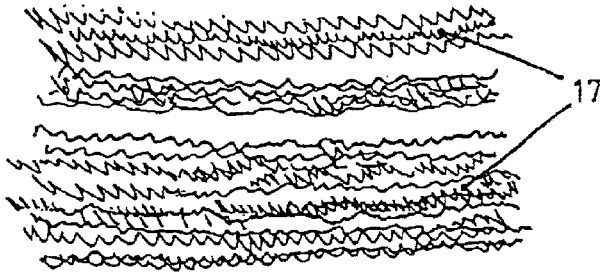
Figure 3C:
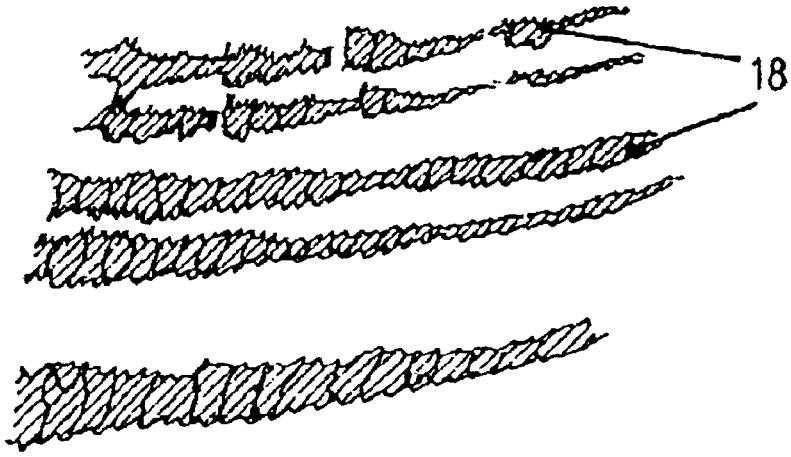

In contrast, FIGS. 3*b* and 3*c* show surface structures according to the invention, whereby in comparison with FIG. 3*a* is it clearly discernible that the structure in FIG. 3*b* is irregular and that in FIG. 3*c* is partly disconnected and comprises individual nicks 17 or 18, whereas the continuous grooves 16 are discernible in FIG. 3*a*.

Sound comparisons between cymbals featuring grooves according to the prior art and cymbals featuring the disconnected structure proposed according to the invention, show distinct differences. The sound produced by way of the cymbals according to the invention is coarser, less linear, earthier, more sustained, and the sound decay is less. In particular a different vibration behavior is evident in the cymbal according to the invention, compared with a conventional cymbal featuring grooves.

In contrast to the machining cutting tool customarily used to produce the structure according to FIG. 3*a*, a rotating tool such as, for example, a rotating milling tool or a milling head is preferably used to produce the irregular or disconnected structures according to FIGS. 3*b* and 3*c*.

Figure 4A:
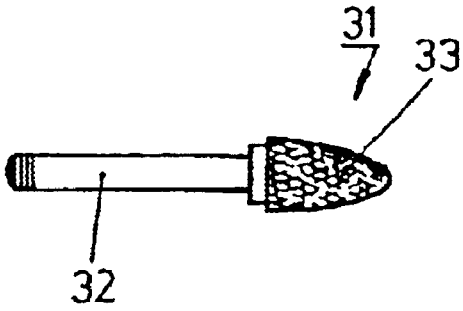
FIGS. 4*a* and 4*b* show possible milling heads that can be used to produce the surface structures or features according to the invention.
Figure 4B:
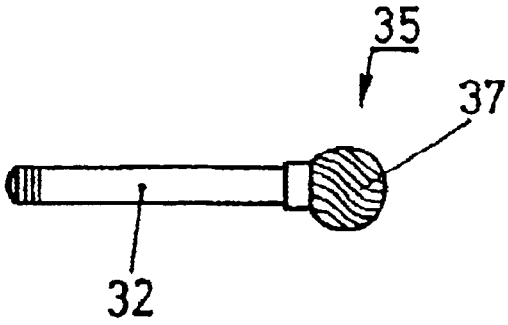

In FIGS. 4*a* and 4*b*, two examples of such a milling head 31 or 35 are shown, in which a corresponding conical milling head 33 or a largely spherical milling head 37, each featuring milling grooves, is respectively arranged on a spindle 32.

Of course, the milling heads in FIGS. 4*a* and 4*b* are merely examples to better explain the present invention.

The cymbals and milling heads shown in FIGS. 1 through 4 are, of course, only examples in order to explain the present invention. In particular the invention is also independent of the metal or the metal alloy used to produce the cymbals. Bronzes are used as a rule, but it is also possible, of course, to produce cymbals from brass or other metals or metal alloys.

The geometrical arrangement of the disconnected structure is not per se specified either, thus it is possible to arrange the structure over the entire surface, on partial surfaces, with a higher or lower density, in the form of ring segments, etc. The depth of penetration of the disconnected structure can also be varied, in accordance with the sound to be produced.

What is claimed is:

1. A percussion instrument, comprising:

a cymbal that includes an umbrella-like ring area and a central domed cupola;

the umbrella-like ring area being at least almost round and comprising a surface; and features arranged on the surface in a circumferential direction, wherein the features are at least one of non-continuous and irregular nicks formed by a milling tool.

2. The percussion instrument of claim 1, wherein the features are ultra-small nicks.

3. The percussion instrument of claim 1, wherein the features are arranged as ring segments.

4. The percussion instrument of claim 1, wherein the features are arranged on only part of the surface.

5. The percussion instrument of claim 1, wherein a density of the features varies from the cupola to an outer periphery of the cymbal.

6. The percussion instrument of claim 1, wherein a density of the features is different in different circumferential areas of the cymbal.

7. The percussion instrument of claim 1, wherein the surface comprises an upper surface.

8. The percussion instrument of claim 7, further comprising a lower surface that includes the features.

9. The percussion instrument of claim 1, wherein the surface comprises a lower surface.

10. The percussion instrument of claim 1, further comprising at least one of at least one continuous groove, at least one hammered area, and at least one worked surface area arranged on the surface.

11. The percussion instrument of claim 10, wherein the surface comprises an upper surface.

12. The percussion instrument of claim 11, further comprising a lower surface that includes the features.

13. A method of making the percussion instrument of claim 1, wherein the method comprises:

subjecting the surface to the milling tool while the milling tool rotates.

14. The method of claim 13, wherein the subjecting comprises subjecting at least part of the surface to the milling tool while the milling tool moves inwardly towards the cupola.

15. The method of claim 13, wherein the subjecting comprises subjecting at least almost an entire part of the surface to the milling tool while the milling tool moves inwardly towards the cupola.

16. The method of claim 13, wherein the subjecting comprises subjecting at least part of the surface to the milling tool while the milling tool moves outwardly away from the cupola.

17. The method of claim 13, wherein the subjecting comprises subjecting at least almost an entire part of the surface to the milling tool while the milling tool moves outwardly away from the cupola.

18. The method of claim 13, further comprising guiding the milling tool to vary a depth of penetration of the features.

19. The method of claim 13, further comprising forming some of the features with a depth of penetration and forming other features with a different depth of penetration.

20. A cymbal, comprising:

a central opening, a lower surface and an upper surface; and features arranged concentrically on at least one of the lower surface and the upper surface, wherein the features comprise at least one of non-continuous nicks and irregular nicks.

21. A method of making the cymbal of claim 20, wherein the method comprises:

subjecting the surface to the milling using a milling tool to form the features.

* * * * *